US005852786A

United States Patent [19]

Bradbury et al.

[11] Patent Number: 5,852,786

[45] Date of Patent: Dec. 22, 1998

[54] PROCESS FOR DECONTAMINATING RADIOACTIVE MATERIALS

[75] Inventors: David Bradbury; George Richard Elder, both of Gloucester, United Kingdom

[73] Assignee: Bradtec Limited, Bristol, United Kingdom

[21] Appl. No.: 849,812

[22] PCT Filed: Dec. 14, 1995

[86] PCT No.: PCT/GB95/02919

§ 371 Date: Jul. 7, 1997

§ 102(e) Date: Jul. 7, 1997

[87] PCT Pub. No.: WO96/19812

PCT Pub. Date: Jun. 27, 1996

[30] Foreign Application Priority Data

Dec. 22, 1994 [GB] United Kingdom ..... 9426023

[51] Int. Cl.[6] ..... G21F 9/00

[52] U.S. Cl. ..... 588/1; 588/13; 423/6; 134/2; 134/7; 210/682; 376/309; 376/310; 976/DIG. 376

[58] Field of Search ..... 588/1, 13; 423/6; 134/2, 7; 210/682; 976/DIG. 376; 376/309, 310

[56] References Cited

U.S. PATENT DOCUMENTS 5,322,644 6/1994 Dunn et al. ..... 423/6

FOREIGN PATENT DOCUMENTS

| | | |
|---|---|---|
| 0522856 | 1/1993 | European Pat. Off. . |
| 0550221 | 7/1993 | European Pat. Off. . |
| 2644772 | 9/1990 | France . |
| 3517400 | 12/1985 | Germany . |
| 2229312 | 9/1990 | United Kingdom . |

OTHER PUBLICATIONS

Database INIS, International Atomic Energy Agency, AN 26 (22):70940 entitled, "Chemical Method to Recover Uranium and Plutonium from Debris in Spent Fuel Storage Tank" to B. Venkataramani et al. (1995).

Database INIS, International Atomic Energy Agency, AN 27 (+): 2014 entitled, "Plutonium Mobility Studies in Soil Sediment Decontaminated by Means of a Soil–Washing Technology" to M.C. Negri et al. (1995).

*Primary Examiner*—Ngoclan Mai
*Attorney, Agent, or Firm*—Watson Cole Grindle Watson, P.L.L.C.

[57] ABSTRACT

A process for the decontamination of radioactive materials which process comprises the steps of: i) contacting the material to be decontaminated with a dilute carbonate containing solution in the presence of ion exchange particles which either contains or have a chelating function bond to them; and ii) separating the ion exchange particles from the dilute carbonate containing solution. The radioactive materials which are treated may be natural materials, such as soil, or man-made materials such as concrete or steel, which have been subjected to contamination.

12 Claims, No Drawings

PROCESS FOR DECONTAMINATING RADIOACTIVE MATERIALS

BACKGROUND OF THE INVENTION

The present invention relates to a process for decontaminating radioactive materials.

Environmental contamination with radioactive materials is a common problem. The problem may occur as a result of mining operations, such as for uranium, or contamination due to operation of nuclear facilities with inadequate environmental controls, or from the disposal of radioactive wastes. Alternatively, contamination may occur as a result of dispersion of uranium billets which have been used as a high density material in military or civil applications as a result of warfare or civil accident.

Mining operations have established practical and economic methods for the recovery of some radioactive elements from contaminated materials. The objective of mining, however, is usually the economic recovery of materials and secondary waste is rarely the major issue. In environmental clean-up, the economic objective is to complete effective clean-up with minimum secondary waste at minimum cost, and the value of recovered radioactive substances is of secondary importance. Techniques and chemicals which would not be economical or appropriate for mining applications may become practical for environmental clean-up.

It is well established that radioactive elements can be recovered from environmental materials by mechanically washing with water with or without surface active additives. However, such procedures are generally limited to the mechanical separation of solids, and will not remove contaminants that are chemically bound to the solid phase.

There are established chemical methods for dissolving insoluble radioactive contaminants in concentrated solvents, such as strong acids in a process known as acid leaching. Such procedures are effective, but are disadvantageous if the spent concentrated solution ultimately becomes waste. In many cases, the concentrated solvents themselves are hazardous in addition to containing the radioactive contaminant that the process is designed to concentrate. The acid leaching and other processes using concentrated solvents to dissolve the radioactive contaminant have the further disadvantage of also dissolving other contaminants that the process was not designed to remove, such as nonradioactive metals.

In the decontamination of the internal surfaces of nuclear reactor circuits, early processes involved washing with concentrated chemical solutions to dissolve contaminants to yield a concentrated solution containing the contamination. The processing of these waste solutions was found to be difficult and inconvenient and resulted in them becoming waste requiring disposal. The technology has progressed to allow the recovery of radioactivity, typically by ion exchange, in a dilute acidic recirculating system. These solutions, being dilute and acidic, do not contain carbonate and are not particularly useful or appropriate for dissolving actinide elements because they do not form soluble complexes with the actinide elements.

In reactor decontamination it has been established that certain organic reagents can be used to dissolve contamination and yield it to an ion exchange resin in a recirculating process in such a way that the organic reagent is continuously re-used. Examples of solutions used in reactor decontamination processes are vanadous formate, picolinic acid and sodium hydroxide. Other processes typically use mixtures of citric acid and oxalic acid. These reactor decontaminating solutions have the disadvantage of not being capable of being used in a single one time application to dissolve actinides, radium and certain fission products such as technetium.

Previous reactor decontaminating solutions do not contain carbonate and are acidic, dissolving the iron oxides which contain the radioactive elements commonly found in contaminated reactor circuits. This non-selective metal dissolving capacity is a disadvantage of the acidic solutions and makes them unsuitable for the decontamination of material such as soil that contains iron and other metals that are not intended to be recovered. Another disadvantage of acidic solutions is that materials such as concrete or limestone are subject to damage or dissolution in an acidic medium. Also, in dealing with previously known washing solutions for treating soil, these solutions contain too many non-selectively dissolved contaminants preventing subjection of the solution to recovery of contaminants and recirculation of the solution to accomplish further decontamination.

It has been established that uranium and transuranic radioactive elements can be dissolved in concentrated acidic (pH <1) chemical systems. The acidity poses difficulties as discussed above. Uranium and sometimes thorium are recovered in mining operations in a concentrated basic medium containing carbonate. The use of concentrated solutions is motivated by the need to dissolve materials at a rate economic for mining operations, and such solutions are not particularly suitable where avoidance of secondary waste is of primary concern. There are also references which suggest that uranium and plutonium can be dissolved in a dilute basic solution containing carbonate, citrate (as a chelating agent) and an oxidizing or reducing agent.

U.S. Pat. No. 5,322,644 describes a method for dissolving radioactive contaminants in a dilute solution having a basic pH and having an effective amount of chelating agent present. The patent also describes the steps for recovery of the contamination from the solution which includes anion or cation exchange or selective cation exchange, and also describes the use of magnetic ion exchangers as a means of separating the contaminants from the contacted material.

It is well known that uranium can be dissolved in a basic carbonate medium and recovered by anion exchange (this is the basis of the so called "resin-in-pulp" process in which porous bags of anion exchange resin can be used to remove carbonate complexes of uranium from slurries of contacted material and dissolving composition). However, as referred to in U.S. Pat. No. 5,322,644 it has been found that carbonate solutions in the absence of a chelating agent are not very effective at dissolving plutonium.

The reason for this inability to dissolve plutonium in the absence of a chelating agent was thought to be due to the relatively poor solubility and stability of the plutonium (IV) carbonate complex, and it has been hypothesised that the presence of a chelating agent such as EDTA in the dissolving composition assists the dissolution by stabilising the dissolved plutonium (IV) as an EDTA complex. Thermodynamic calculations have supported this hypothesis. It has also been shown that the presence of an oxidizing agent is beneficial for the dissolution of both uranium and plutonium. It is known in the case of uranium that the oxidizing agent has the function of raising the uranium to the (VI) oxidation state in which state it passes into solution. The improved kinetics of dissolution which occurs on a change of oxidation state of the metal in a solid lattice is well established.

SUMMARY OF THE INVENTION

We have now developed a process for decontaminating radioactive materials using a dissolving composition containing carbonate which does not contain a chelating agent therein.

Accordingly, the present invention provides a process for the decontamination of radioactive materials which process comprises the steps of:

i) contacting the material to be decontaminated with a dilute carbonate-containing solution in the presence of ion exchange particles which either contain or have a chelating function bound to them; and ii) separating the ion exchange particles from the dilute carbonate containing solution.

The radioactive materials which are treated according to the process of the invention may be natural materials, such as soil, or man-made materials such as concrete or steel, which have been subjected to contamination.

The present invention is of particular utility with regard to the dissolution and recovery of the actinide elements and much greater efficiency in the dissolution and recovery of the actinide elements can be achieved as compared to the process described in U.S. Pat. No. 5,322,644. One reason for the greater selectivity of the process of the present invention, as compared to U.S. Pat. No. 5,322,644 is that since there is no chelating agent present in the dissolving solution, the tendency of the chelating agent to dissolve non-radioactive ions such as iron is avoided.

The process of the present invention is very efficient in that the radioactive contamination is removed from the dissolving composition at the same time as its dissolution, thus keeping the concentration of dissolved contaminants to a minimum, thereby reducing the requirements for rinsing and improving the decontamination achievable.

In carrying out the process of the present invention the material to be decontaminated is contacted with a dissolving solution and at the same time the solution is contacted with solid ion exchange particles which have a chelating agent bound to them, or which contain a chelating function. The contacting device should generally create adequate agitation of the solid materials with the solution, but not be sufficiently violent to create damage to the ion exchange particles. The ion exchange particles may be suspended in a porous bag within the dissolving solution, or (if they contain a magnetic material) may be added directly to the mixture of the dissolving solution and contacted material. In the event that the material to be decontaminated is a large object, the dissolving solution can be contacted with the object and rapidly returned to a vessel in which contact is achieved between the dissolving solution and the ion exchange material. Contact between the contacted material and the dissolving solution is continued until the contaminant is transferred from the contacted material, by way of dissolution into the dissolving solution, to the ion exchange material.

The next step involves the separation of the ion exchange material. If the ion exchange material is present in a porous bag, the bag containing the ion exchange material may simply be removed from the dissolving solution. If the ion exchange material is intermingled with the contacted material, the two may be separated for example by magnetic separation when the ion exchange particles contain a magnetic material. The dissolving solution and contacted material (being essentially non-magnetic) will pass through the magnetic separator while the ion exchange material is retained.

In certain applications it may not be necessary to separate the contacted material from the dissolving solution. The carbonate salts are widely present in natural materials and may be acceptable for return of the contacted material to the environment. If separation of the contacted material from the dissolving solution is required, this can be achieved by standard solid/liquid separation devices such as pinch-press or belt-press filters. The separated dissolving solution can then be recycled to contact further material to be decontaminated.

The dissolving solution comprises an effective amount of a dilute, basic, carbonate solution, sufficient to dissolve the contaminants in the material. The sources of carbonate include carbon dioxide gas, carbonic acid, sodium carbonate, sodium bicarbonate or other carbonate salts. The carbonate salts form soluble complexes with various actinides. Other anion radicals which are capable of forming soluble complexes with actinides may also be used.

The dissolving solution has a basic pH, that is, any pH from 7 to 11, and preferably in the range of from 9 to 11, with the most preferred pH being about 9. The process includes the step of adjusting the pH of the dissolving solution to about 9 by adding an effective amount of a base, such as sodium hydroxide. The term "base" used herein includes any substance capable of raising the pH of a solution above pH 7 with the substance not otherwise interfering with the dissolving function of the dissolving solution. Other bases contemplated for use in the solution include potassium hydroxide, ammonium hydroxide and ammonium carbonate. Ammonium carbonate is rather noxious, but has the added advantage for waste management that it can be recovered from solution by evaporation from solution. Any base, according to the above definition, could be used. The amount of base that will be effective to adjust the pH to the preferred range will depend on the specific base used, the other constituents of the solution, and the characteristics of the particular soil or other material being processed.

Alternatively, the carbonate solution of the present process can also be used for the dissolution of some actinides at neutral pH.

The process of the present invention may further include the step of generating carbonate by adding an effective amount of carbon dioxide gas to the dissolving solution prior to the contacting step. The carbon dioxide gas is bubbled through the dissolving solution containing all of the components, except carbonate, to generate a carbonate solution according, for example, to the following equations:

$$CO_2+H_2O \rightarrow H_2CO_3$$

$$2NaOH+H_2CO_3 \rightarrow Na_2CO_3+2H_2O$$

The process of bubbling carbon dioxide gas through the dissolving solution can also be used to adjust the pH of the solution to the appropriate range. The effective amount of carbon dioxide gas sufficient to generate carbonate and adjust the pH of the solution of the instant process can be determined by standard analytical methods. Alternatively, the carbonate solution used in the process of the present invention may be made by adding an effective amount of a carbonate salt to the dissolving solution. The preferred concentration of carbonate is about 1 molar.

The solution used in the process of the present invention may also include an effective amount of an oxidizing agent, such as hydrogen peroxide preferably at a concentration of about 0.005 molar. The oxidizing agent can raise the oxidation state of certain actinides to facilitate their dissolution in the dissolving solution as shown by the following general equation:

$$UO_2+H_2O_2+3Na_2CO_3 \rightarrow Na_4UO_2(CO_3)_3+2NaOH$$

Oxidizing agents are also needed in the dissolving solution to dissolve plutonium. Other effective oxidizing agents include ozone, air and potassium permanganate.

The preferred dissolving solution of the present invention comprises about 1 molar carbonate, about 0.005 molar hydrogen peroxide and an effective amount of sodium hydroxide so that the solution pH can be adjusted to pH 9. Solutions comprising other amounts of the above constituents that are sufficient to dissolve actinides in soil and other materials are also contemplated. Such solutions can comprise from 0.01 to from 1 molar carbonate and from 0.005 to 0.3 molar hydrogen peroxide.

Raising the temperature above ambient has been found to be effective. Any temperature between ambient and 100° C. can be used, preferably about 50° C.

A further step in the process of the present invention is separating the contaminants from the dissolving solution by absorption on an ion exchange medium. The absorption used in the process involves the use of a chelation reaction on the ion exchange resin as is illustrated below for an iminodiacetic acid function chemically bound to a solid particle:

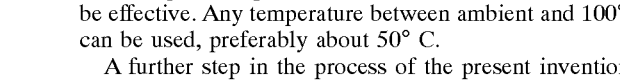

$$Na_4UO_2(CO_3)_3+2(Resin—N[CH_2COO]_2Na_2)\rightarrow 2(Resin—N[CH_2COO]_2)UO_2Na_2+3Na_2CO_3$$

Because of the stability of the complexes so formed in comparison with carbonate complexes, the chelation reaction is capable of removing actinides from the dissolving solution in the presence of concentrations of carbonate which are sufficiently high to allow dissolution of actinides from aged soils in which the contamination has become strongly absorbed onto the soil.

The particular chelation reaction shown above is exemplary only and any similar chelation reaction can be used (e.g., using such functions as resorcinol arsonic acid, 8-hydroxyquinoline or amidoxime). The prime requirement of the chelating function is that it forms a thermodynamically stable complex with the actinide elements it is desired to remove.

The chelating function may be bound by physical means or by ion exchange to a solid absorbent for use in the present invention, but the preferred method involves the incorporation of the chelating function by chemical bonding onto the solid particle. Examples of suitable commercially available chelating ion exchangers of this type are DOWEX A1, DUOLITE ES346, C466 and 467, and CHELEX 100. The use of such ion exchangers in the process of the present invention generally requires that the solid particles are suspended in the dissolving solution by confinement in a porous bag.

The chelating function can also be provided by physical absorption, ion exchange or chemical bonding onto a solid material which is magnetic, such as described in European Patent No. 0522856. In this case the solid magnetic material containing the absorbed contaminants can be recovered from the dissolving solution by magnetic separation.

An additional step can be incorporated in the process of the present invention of recovering the contaminants from the chelating ion exchanger. Eluting the contaminants is accomplished by means of a solution which removes the contaminants from the absorbent. The eluting solution, also known as the eluent, can be predictably chosen to be selective for the specific contaminant based on the known characteristics of the contaminant and the absorbent. A typical eluent is an acid such as nitric acid at an intermediate concentration of about 1 molar. The degree to which the contaminant is concentrated in the eluent can be varied according to the specific eluent used, but will in any case be more concentrated than in the unprocessed contaminated material.

The step of recovering the radioactive contaminants can further include the step of recirculating to the contacting step the dissolving solution that has been separated from the contacted material.

The present invention also provides means for controlling the fluid volume in the contacting step. Either the soil leaving the process can have a higher water content than that entering, or evaporation can be used to recover pure water from the dissolving solution. One of these or other suitable methods can be used to prevent the build up of fluid volume.

The following non-limiting Example illustrates the present invention.

EXAMPLE 1

A magnetic resin having an imino diacetic acid function was prepared according to the method as described in European Patent No. 0522856. The resin was converted to the ammonium form by treatment with ammonium acetate (0.1M). Aged plutonium-contaminated soil acquired from a site in USA (6 grams) was mixed with a dissolving solution (100 mls) containing 1M carbonate adjusted to pH 9. Hydrogen peroxide (51 microliters, 30% solution) and magnetic resin (0.8 g dry weight) was added and the mixture was stirred for 2 hours at 50° C. The resin was separated from the soil by magnetic separation and washed with water. The dissolving solution was separated from the soil by filtration. The magnetic resin was regenerated by washing with 8M nitric acid. The soil, the eluent from regenerating the resin and the dissolving solution were analyzed for plutonium.

The average results of triplicate samples indicate that 27% of the plutonium originally present on the soil was still present on the soil, 68% of the plutonium originally present on the soil had been transferred to the eluent solution and 5% of the plutonium originally present on the soil was recovered from the dissolving solution.

EXAMPLE 2

A magnetic resin having an iminodiacetic acid function was prepared as in Example 1. The resin was used in the hydrogen form. Aged plutonium-contaminated soil acquired from a site in the USA (6 g) was mixed with a dissolving solution (100 mls) containing 1M carbonate adjusted to pH 9. Hydrogen peroxide (51 microliters, 30% solution) and magnetic resin (0.8 g dry weight) was added and the mixture was stirred for 2 hours at 50° C. The soil was separated from the solution and resin. The same soil was subjected four further times to fresh batches of resin and solution using the same procedure. At the end of the 5 contacts the average of two duplicate samples showed that the concentration of plutonium in the soil, originally 35.8 Bq $g^{-1}$, had been reduced to 3.7 Bq $g^{-1}$, i.e., >90% of the plutonium had been removed from the soil.

We claim:

1. A process for the decontamination of radioactive materials which process comprises the steps of:

i) contacting the material to be decontaminated with a dilute carbonate-containing solution in the presence of ion exchange particles which either contain or have a chelating function bound to them; and ii) separating the ion exchange particles from the dilute carbonate-containing solution.

2. A process as claimed in claim 1, wherein the dilute carbonate-containing solution has a pH in the range of from 7 to 11.

3. A process as claimed in claim 1, wherein the dissolving solution additionally comprises an oxidising agent.

4. A process as claimed in claim 3, wherein the oxidising agent is hydrogen peroxide.

5. A process as claimed in claim 1, wherein the chelating function comprises iminodiacetic acid, resorcinol arsonic acid, 8-hydroxyquinoline or amidoxime groups.

6. A process as claimed in claim 1, wherein the ion exchange particles are also magnetic.

7. A process as claimed in claim 6, wherein the ion exchange particles contain the magnetic material embedded therein.

8. A process as claimed in claim 6 wherein the magnetic ion exchange particles are separated by a magnetic separation device.

9. A process as claimed in claim 1, wherein the contaminants are recovered from the chelating ion exchanger.

10. A process as claimed in claim 9, wherein the contaminants are recovered by elution with a suitable eluent.

11. A process for decontaminating radioactive materials which comprises the steps of:

i) providing a porous bag containing ion exchange particles which contain or have a chelating function bound thereto, ii) contacting the radioactive materials to be decontaminated with a dilute carbonate-containing solution and in the presence of said porous bag containing said ion exchange particles, and iii) separating said porous bag containing said ion exchange particles from said dilute carbonate-containing solution.

12. A process for decontaminating radioactive materials which comprises the steps of:

i) contacting the radioactive materials to be decontaminated with a dilute carbonate-containing solution in the presence of ion exchange particles which contain or have a chelating function bound thereto to form a mixture, and ii) passing said mixture through pinch-press or belt-press filters to separate decontaminated material from said dilute carbonate-containing solution.

* * * * *